United States Patent [19]

Roffelsen

[11] 4,456,172

[45] Jun. 26, 1984

[54] METHOD OF AND APPARATUS FOR THE DEGASIFICATION OF CIRCULATION SYSTEMS FOR LIQUIDS

[75] Inventor: Franciscus Roffelsen, Helmond, Netherlands

[73] Assignee: Spiro Research B.V., Helmond, Netherlands

[21] Appl. No.: 279,259

[22] Filed: Jul. 1, 1981

Related U.S. Application Data

[63] Continuation of Ser. No. 017,083, Mar. 5, 1979, abandoned.

[30] Foreign Application Priority Data

Mar. 11, 1978 [DE] Fed. Rep. of Germany ..... 2810583

[51] Int. Cl.[3] ..... F24D 3/10

[52] U.S. Cl. ..... 237/66; 55/39

[58] Field of Search ..... 237/66, 56, 8 R, 8 C; 137/593; 126/132; 122/47, 488; 55/39

[56] References Cited

U.S. PATENT DOCUMENTS 3,195,294 7/1965 Verdura et al. ..... 237/66

FOREIGN PATENT DOCUMENTS 2604130 5/1977 Fed. Rep. of Germany ..... 237/66

*Primary Examiner*—Albert J. Makay
*Assistant Examiner*—Henry Bennett
*Attorney, Agent, or Firm*—Toren, McGeady and Stanger

[57] ABSTRACT

In a closed circulation system containing a constant amount of liquid, a force is generated for driving the liquid through the system. A branch line extends from the circulation line of the system at a point adjacent to and closely downstream from the location at which the force generating circulation is effected. A collecting chamber is provided in the branch line spaced from the circulation line. Gases dissolved in the liquid are released at the location of the force generation and the gases are removed through the branch line and the collecting chamber. Downstream from the branch line the liquid is either cooled or returned at least to normal pressure for its continued circulation so that it is able to absorb air from the air accumulations within the system with which the liquid comes into contact.

6 Claims, 1 Drawing Figure

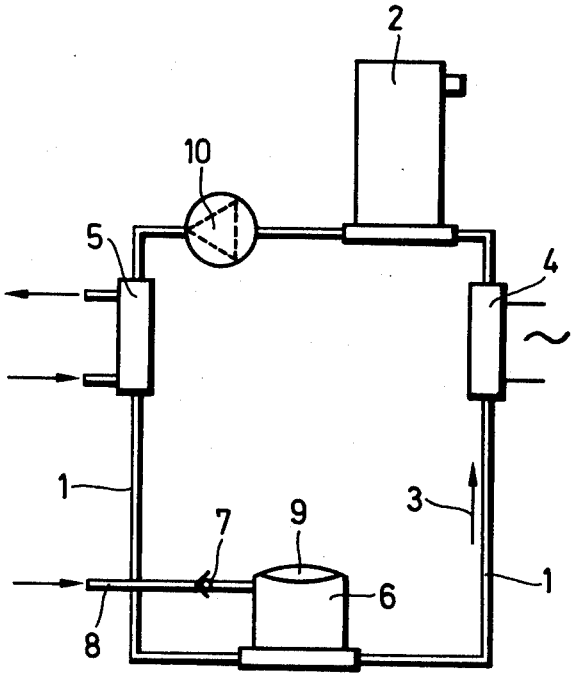
2
10
5
4
1
3
7
9
6
1
8

METHOD OF AND APPARATUS FOR THE DEGASIFICATION OF CIRCULATION SYSTEMS FOR LIQUIDS

This is a continuation of application Ser. No. 017,083, filed Mar. 5, 1979, now abandoned.

The invention relates to the solution of the problem that corrosion phenomena are observed to an ever-increasing degree during the operation of circulation systems for an always constant amount of liquid, for example, in central heating systems. This corrosion occurs after long periods of operation on those metal surfaces which come into contact with the circulating liquids, for example, the walls of pipe lines, heat exchangers, boilers as well as the rotors and housings of circulating pumps.

These corrosion phenomena are generally attributed to the oxygen content of the air which is conveyed by the circulating water and has remained in the system as a residue during the first filling, or has entered the system due to leaks at the points of connection between pipe line parts and at the points of attachment of fittings, or during refilling of the operating water.

Particularly the fresh air which again and again enters the system is considered the reason that it is not possible to effectively counteract the corrosion in spite of the use of gas separating devices which are known in many embodiments.

Accordingly, almost as a last resort, to an increasing degree chemical additives to the operating water are offered which form coating layers on the walls of the pipes and, thus, protect the walls from the influence of the air conveyed by the operating water, if it is not decided in the first place to use corrosion-resistant materials for all parts of the circulation system.

By contrast, the invention is based on the task first to determine the actual cause for the undesirable corrosion phenomena which occur even in circulation systems with satisfactory gas separation, and then to eliminate the cause.

In this regard, numerous tests performed over long periods of time have shown that, in the circulation systems of heating plants which were believed to be free of air, corrosion occurs mainly at the boiler walls and especially at the rotors of circulating pumps. These findings, in turn led to the conclusion that not the air reaching the system from the atmosphere, or at least not this air alone, is responsible for the corrosion phenomena, but the air and any other gases which are dissolved in the circulating water and are temporarily released only during the operation. This conclusion is obviously confirmed thereby that it was possible to determine as the points of maximum corrosion the points to maximum heating and maximum negative pressure, namely the boiler walls which are exposed to the heat source and the rotors of the circulating pumps.

At these points the circulating water has a content of dissolved gases which is significantly reduced below the saturation value of water of normal temperature, be it by heating, negative pressure or both. Accordingly, through experience, experiments and considerations, it was possible to establish the general teaching that it is possible to separate the gas from a circulation systems when, in the vicinity of the point where force generating the circulation acts (heat and/or negative pressure), the gases dissolved in the circulating liquid are released and removed from the liquid to such an extent that, during its further circulation, the liquid which is again cooled and is brought to normal or excess pressure, is able to absorb those gases which are soluble in the liquid and are picked up from gas accumulations with which the liquid comes into contact.

In special cases, for example, in very tall buildings where the water column pressure acting on a low-lying deaeration point would prevent a release of dissolved air, the necessary equalization of pressure can be ensured by raising the deaeration point or in another manner, for example, by arranging the deaeration point and a throttling point upstream of the deaeration point in a line which is parallel to the flow line. In setting up the above-mentioned teaching it seemed permissible to utilize the experience obtained from testing hot water heating systems in other circulation systems for liquids, for example, hydraulic systems, since, also in these cases the liquid used for force transmission is heated at some points and cooled at others and is continuously subject to change between negative and excess pressures. If oil is used instead of water as the pressure medium, the released dissolved air does not have a corroding effect, but, and this is no less disadvantageous, the oil acts as an elastic cushion which impairs the force transmission.

However, a prerequisite for the effectiveness of this method is that the gas released from the circulating liquid is, if possible, completely removed from the circulation system. The more complete this requirement is met, the faster a state is reached in which all the gas present in the system is absorbed and it is also no longer possible that any absorbed gas is released.

It is relatively simple to remove relatively large bubbles of picked-up foreign air by means of known gas separators which are arranged at any chosen point. These gas separators consist essentially of a pipe branch which extends upwardly from the line system and leads to a collecting chamber for the gas which has risen from the liquid, the collecting chamber being connected to the outside air either directly or through a float-controlled valve. On the other hand, there are certain difficulties in separating the extremely small bubbles which are released by heating or negative pressure and are not visible to the naked eye, because of their very small buoyancy and due to the turbulenece of the liquid which circulates in the system with frequent changes of direction. However, it was possible to overcome these difficulties by means of an air separator which was developed for this purpose, but does not belong to the invention, wherein the circulating liquid which is dispersed by the released gas is conducted with temporarily reduced flow velocity underneath a column of liquid which is at rest in the upwardly extending pipe branch formed by the separator housing and is only then cooled and, if necessary, brought to normal or excess pressure.

In the boundary region between the circulating liquid and the liquid which is at rest in this air separator, the liquid which contains the released gas mixes with the gas-free liquid, from where even finest bubbles can rise into the liquid column which is at rest and within this column further into the collecting chamber.

It is obvious that such an air separator operates best the closer it is arranged to that point of the circulation system where the largest amount of released gas is present. Accordingly, for heating systems this results in the recommendation to arrange the air separator immediately behind the boiler and in front of the suction side of a possibly existing booster pump.

However, in circulation systems which do not have a heat source it is necessary to provide closely in front of the air separator the special heating device and, if necessary, a cooling device behind the air separator.

The drawing schematically illustrates an embodiment of the apparatus which is suited to carry out the method which forms the subject matter of the invention.

In its simplest form, this appartus consists of a self-contained circulation line 1, an air separator 2 extending upwardly from a horizontally extending part of the line, a heating device 4 and a cooling device 5. The housing of the air separator 2 which is open toward the top forms an upwardly extending branch of the circulation line 1. Its inside cross-section is four times as large as the one of the circulation line. The circulation line 1 is completely filled with water and the air separator housing 2 is filled with water up to an upper space which is connected to the outside air. Accordingly, this space forms a collection chamber for the air which has reached the separator housing from the circulation line and has risen in the housing, while the remaining portion of the separator housing corresponds to the expansion tank which is conventionally used in heating systems with open circulation. The heating device 4 arranged on one side of the air separator 2 and the cooling device 5 arranged on the other side ensure that in the circulation line 1 continuous flow in the direction of arrow 3 is generated and that the water flowing through the air separator is heated to 70° C. from otherwise 35° C. Opposite the air separator 2, a transparent, completely enclosed control vessel 6 is arranged in the circulation line 1. This control vessel 6 forms a branch of the circulation line 1 which also extends upwardly. The control vessel is connected through a check valve 7 to a line 8 through which the apparatus is filled with water, but through which also a small amount of air can be blown into the vessel 6, the air forming a visible bubble 9 in the vessel 6.

When this apparatus is operated at the above-stated temperatures it can clearly be seen that an air bubble which is present in the control vessel becomes increasingly smaller and flatter, at first quickly and then slower and slower, until it finally disappears completely. This process takes place significantly faster when the water circulation is accelerated by means of a pump 10 which is arranged, as seen in flow direction, closely behind the air separator and which is indicated by broken lines and, in addition, when the negative pressure generated in the water by the pump favors the release of dissolved air.

In the apparatus constructed for control purposes, the cooling device is only provided because it must be expected due to the length of the circulation line of only a few meters that the heated water is not sufficiently cooled during one circulation.

Moreover, tests performed by scientific institutes have confirmed that the means provided by the invention make it possible to lower, in open as well as in closed circulation systems of heating systems which are operated with excess pressure, the saturation value of the operating water to such an extent that the water no longer releases any harmful amounts of dissolved air at the points of highest operating temperature and lowest operating pressure, but that the water completely absorbs any air which might be present in its circulation path.

During the operation of the illustrated apparatus, the air content of 4 l water was reduced within about five hours from 15 to 5 ml/l and, a little later, to 4 ml/l. This corresponds to an oxygen content of approximately 0.08%. This is a concentration which cannot cause any corrosion damage.

I claim:

1. Heating system including deaeration of dissolved extremely small gas bubbles from a circulating liquid comprising a closed loop for circulating a liquid heat carrier, said closed loop having an upper horizontally extending part, means in said closed loop for circulating the liquid heat carrier, means in said closed loop for heating the liquid heat carrier, a branch line connected to and extending upwardly from said horizontally extending part of said closed loop immediately adjacent to and downstream from said means for heating the liquid heat carrier for containing a body of the liquid heat carrier therein in the at-rest condition with the lower end of said branch line and said horizontally extending part of said closed loop forming an interface between the liquid in said closed loop and the liquid in said branch line so that the liquid in said closed loop continues to flow past the interface at a temporarily reduced rate of flow velocity whereby extremely small gas bubbles can be released from the circulating liquid at the interface into said branch line, an air separator connected to said branch line upwardly from the interface with said closed loop and forming a continuation of said branch line for containing the body of liquid heat carrier in the at-rest condition, said circulating means comprising a pump located in said closed loop adjacent to and downstream from said branch line containing said air separator so that the liquid flowing in said closed loop past said air separator enters the suction side of said pump, said air separator having an enclosed air collecting chamber, and a float-controlled valve connected to said aid collecting chamber for regulating flow of air of gas from the collecting chamber to the ambient air.

2. Method of deaerating dissolved extremely small gas bubbles from a circulation system including a closed circulation line containing a constant amount of liquid, comprising the steps of generating a force for circulating the liquid through the circulation line by one of heating the circulating liquid and generating a negative pressure in the circulating liquid, positioning the force generation at a determined location in the circulation line, providing an upwardly extending branch line off a generally horizontally extending part of the circulation line immediately adjacent to the determined location of the circulating force, providing an air collecting chamber in the branch line spaced upwardly from the circulation line, connecting the collecting chamber to the ambient air, filling the branch line from the circulation line into the air collecting chamber with the liquid flowing in the circulation line so that the upwardly extending column of liquid is at-rest within the branch line and air collecting chamber and providing an interface between the liquid flowing through the circulation line and the liquid in the at-rest condition within the branch line, releasing gases dissolved in the circulating liquid in the form of extremely small gas bubbles invisible to the naked eye by the force generating step, effecting temporarily reduced flow velocity of the liquid in the horizontally extending part of the circulation line directly underneath the interface with the upwardly extending column of liquid at-rest and, while the liquid continues circulating in the circulation line, removing the extremely small gas bubbles of the released gases at the interface from the circulation line into the branch line for flow upwardly through the liquid in the at-rest condition into the collecting chamber and subsequent discharge into the ambient air, and at a location adjacent to and downstream from the upwardly extending branch line providing one of cooling the liquid and returning the liquid to at least normal pressure in correspondence to the force generating step so that the liquid during its continued flow through the circulation line is able to dissolve air from air accumulations with which the circulating liquid comes into contact in the circulation line so that the dissolved air can be subsequently released in the form of extremely small gas bubbles.

3. Appartus for deaerating dissolved extremely small gas bubbles from a circulation system through which a constant amount of liquid is circulated, comprising a closed circulation line for containing the constant amount of liquid, said circulation line have an upper generally horizontally extending part, a branch line connected to and extending upwardly from said horizontally extending part of said circulation line, means located in said circulation line immediately adjacent to said branch line for generating a force for circulating the liquid through said circulation line with the force acting at said branch line, said branch line arranged to contain a body of the liquid flowing through said circulation line in the at-rest condition and the body of liquid in the at-rest condition in said branch line arranged to form an interface with the flow through said circulation line so that a temporarily reduced flow velocity of the liquid in said circulation liquid is effected directly underneath said branch line with the liquid continuing to flow in said horizontally extending part past the interface, a collecting chamber positioned in said branch line spaced upwardly from the interface with said circulation line and arranged to hold the liquid in said branch line in the at-rest condition for collecting air and gases in the form of extremely small bubbles, said collecting chamber being connected to the ambient air, and means located adjacent to and downstream from said branch line for effecting an opposite action on the liquid to that provided in generating the force for circulating the liquid.

4. Method, as set forth in claim 2, including the step of sizing the transverse cross-section of the branch line at least four times greater than the transverse cross-section of the circulating line.

5. Appartus, as set forth in claim 3, wherein a booster pump is located in said circulation line intermediate said branch line and said means for effecting an opposite action.

6. Apparatus, as set forth in claim 3, wherein said branch line having a transverse flow cross-section approximately four times greater than the transverse flow cross-section through said horizontally extending part of said closed loop.

* * * * *